US008777382B2

(12) United States Patent
Kato et al.

(10) Patent No.: US 8,777,382 B2
(45) Date of Patent: Jul. 15, 2014

(54) INKJET HEAD AND IMAGE FORMING DEVICE

(75) Inventors: Masaki Kato, Tokyo (JP); Kiyoshi Yamaguchi, Kanagawa (JP); Takahiko Kuroda, Hyogo (JP); Satoshi Mizukami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/365,352

(22) Filed: Feb. 3, 2012

(65) Prior Publication Data

US 2012/0206545 A1 Aug. 16, 2012

(30) Foreign Application Priority Data

Feb. 10, 2011 (JP) ..... 2011-026905

(51) Int. Cl.
*B41J 2/045* (2006.01)

(52) U.S. Cl.
USPC ..... 347/70

(58) Field of Classification Search
USPC ..... 347/70, 71
See application file for complete search history.

(56) References Cited

U.S. PATENT DOCUMENTS

| | | | | |
|---|---|---|---|---|
| 7,559,631 | B2 | 7/2009 | Shimada et al. | |
| 7,850,279 | B2 * | 12/2010 | Usami et al. | 347/50 |
| 2008/0024554 | A1 | 1/2008 | Usami et al. | |
| 2008/0218556 | A1 * | 9/2008 | Seto et al. | 347/50 |
| 2010/0315471 | A1 | 12/2010 | Kihira et al. | |

FOREIGN PATENT DOCUMENTS

| | | |
|---|---|---|
| JP | 2001-260352 | 9/2001 |
| JP | 3738804 | 11/2005 |
| JP | 2008-44294 | 2/2008 |
| JP | 4117504 | 2/2008 |
| JP | 2008-227144 | 9/2008 |
| JP | 2009-83464 | 4/2009 |
| JP | 4362859 | 8/2009 |
| JP | 4371209 | 9/2009 |
| JP | 2010-42683 | 2/2010 |
| JP | 2011-714 | 1/2011 |

OTHER PUBLICATIONS

May 21, 2012 European search report in connection with counterpart European patent application No. 12 15 3968.

* cited by examiner

*Primary Examiner* — Lisa M Solomon
(74) *Attorney, Agent, or Firm* — Cooper & Dunham LLP

(57) ABSTRACT

Disclosed is an inkjet head that includes individual liquid chambers having liquid droplet discharging holes; an oscillation plate; piezoelectric elements formed by laminating a lower electrode, a piezoelectric material, and upper electrodes on the oscillation plate, wherein the lower electrode is a common electrode and the upper electrode is an individual electrode; a common electrode wiring connected to the lower electrode; and individual electrode wirings connected to the corresponding upper electrodes of the piezoelectric elements, wherein driving signals are individually input to the corresponding individual electrode wirings. The inkjet head further includes an upper layer insulator film; an intermediate layer insulator film; and a lower layer insulator film. The intermediate layer insulator film and the upper layer insulator film have openings for exposing the piezoelectric elements.

12 Claims, 7 Drawing Sheets

INKJET HEAD AND IMAGE FORMING DEVICE

BACKGROUND OF THE INVENTION

1. Field of the Invention

An embodiment of the present invention relates to an inkjet head using piezoelectric elements and an image forming device using the inkjet head.

2. Description of the Related Art

As a technique for densifying an inkjet head using piezoelectric elements, a technique which utilizes Micro-Electro-Mechanical Systems (MEMS) has been disclosed, for example, as shown in Patent Document 1 (Japanese Published Unexamined Application No. 2011-000714). Namely, by forming finer actuators and fluid channels using semiconductor device manufacturing techniques, density of nozzles in the head can be increased. Thus the head can be downsized, and a higher integration of the head can be realized.

SUMMARY OF THE INVENTION

In one aspect, there is provided an inkjet head including plural individual liquid chambers formed with partition walls, each of the individual liquid chambers having a liquid droplet discharging hole; an oscillation plate attached to surfaces of plural of the individual liquid chambers, the surfaces of plural of the individual liquid chambers being different from surfaces where the liquid droplet discharging holes are provided; plural piezoelectric elements arranged at positions corresponding to the plural of the individual liquid chambers on the oscillation plate, each of the piezoelectric elements being formed by laminating a lower electrode, a piezoelectric material, and an upper electrode, in this order on the oscillation plate, wherein the lower electrode is a common electrode and the upper electrode is an individual electrode; a common electrode wiring connected to the lower electrode; and individual electrode wirings individually and conductively connected to the corresponding upper electrodes of plural of the piezoelectric elements, wherein driving signals are individually input to the corresponding individual electrode wirings. The inkjet head further includes an upper layer insulator film that coats at least the common electrode wiring and surfaces of the individual electrode wirings; an intermediate layer insulator film that is provided between the individual electrode wirings and the lower electrode, at least, at areas where the individual electrode wirings and the lower electrode overlap, the intermediate layer insulator film being a lower layer of the upper layer insulator film; and a lower layer insulator film that coats, at least, surfaces of the piezoelectric elements, the lower layer insulator film being a lower layer of the intermediate layer insulator film. The intermediate layer insulator film and the upper layer insulator film have openings for exposing the piezoelectric elements.

In another aspect, there is provided an image forming device that includes an inkjet head including plural individual liquid chambers formed with partition walls, each of the individual liquid chambers having a liquid droplet discharging hole; an oscillation plate attached to surfaces of plural of the individual liquid chambers, the surfaces of plural of the individual liquid chambers being different from surfaces where the liquid droplet discharging holes are provided; plural piezoelectric elements arranged at positions corresponding to the plural of the individual liquid chambers on the oscillation plate, each of the piezoelectric elements being formed by laminating a lower electrode, a piezoelectric material, and an upper electrode, in this order on the oscillation plate, wherein the lower electrode is a common electrode and the upper electrode is an individual electrode; a common electrode wiring connected to the lower electrode; and individual electrode wirings individually and conductively connected to the corresponding upper electrodes of plural of the piezoelectric elements, wherein driving signals are individually input to the corresponding individual electrode wirings. The inkjet head further includes an upper layer insulator film that coats at least the common electrode wiring and surfaces of the individual electrode wirings; an intermediate layer insulator film that is provided between the individual electrode wirings and the lower electrode, at least, at areas where the individual electrode wirings and the lower electrode overlap, the intermediate layer insulator film being a lower layer of the upper layer insulator film; and a lower layer insulator film that coats, at least, surfaces of the piezoelectric elements, the lower layer insulator film being a lower layer of the intermediate layer insulator film. The intermediate layer insulator film and the upper layer insulator film have openings for exposing the piezoelectric elements.

According to the embodiment, the inkjet head includes the upper layer insulator film that coats at least the surfaces of the individual electrode wiring; the intermediate layer insulator film that is provided between the individual electrode wirings and the lower electrode, at least, at the areas where the individual electrode wirings and the lower electrode overlap, the intermediate layer insulator film being a lower layer of the upper layer insulator film; and the lower layer insulator film that coats, at least, surfaces of the piezoelectric elements, the lower layer insulator film being a lower layer of the intermediate layer insulator film. Further, the intermediate layer insulator film and the upper layer insulator film have the openings for exposing the piezoelectric elements. Therefore, degradation of the piezoelectric materials, that is caused by the plasma in the semiconductor processing in the inkjet head manufacturing process, or by the moisture in the air under the usage environment of the device, can be prevented, and sufficient amounts of deformations of the piezoelectric elements can be ensured. Further, since there is no limitation on wiring of, such as the individual electrodes, a higher integration is possible.

According to the embodiment, the image forming device includes the inkjet head. Since the image forming device stably discharges ink droplets through the liquid droplets discharging holes of the inkjet head, a high-quality image can be stably formed. Further, a rate of failure in the image formation process is reduced, and cost reduction can be achieved.

Other objects, features and advantages of the present invention will become more apparent from the following detailed description when read in conjunction with the accompanying drawings.

DETAILED DESCRIPTION OF THE PREFERRED EMBODIMENTS

Figure 1:
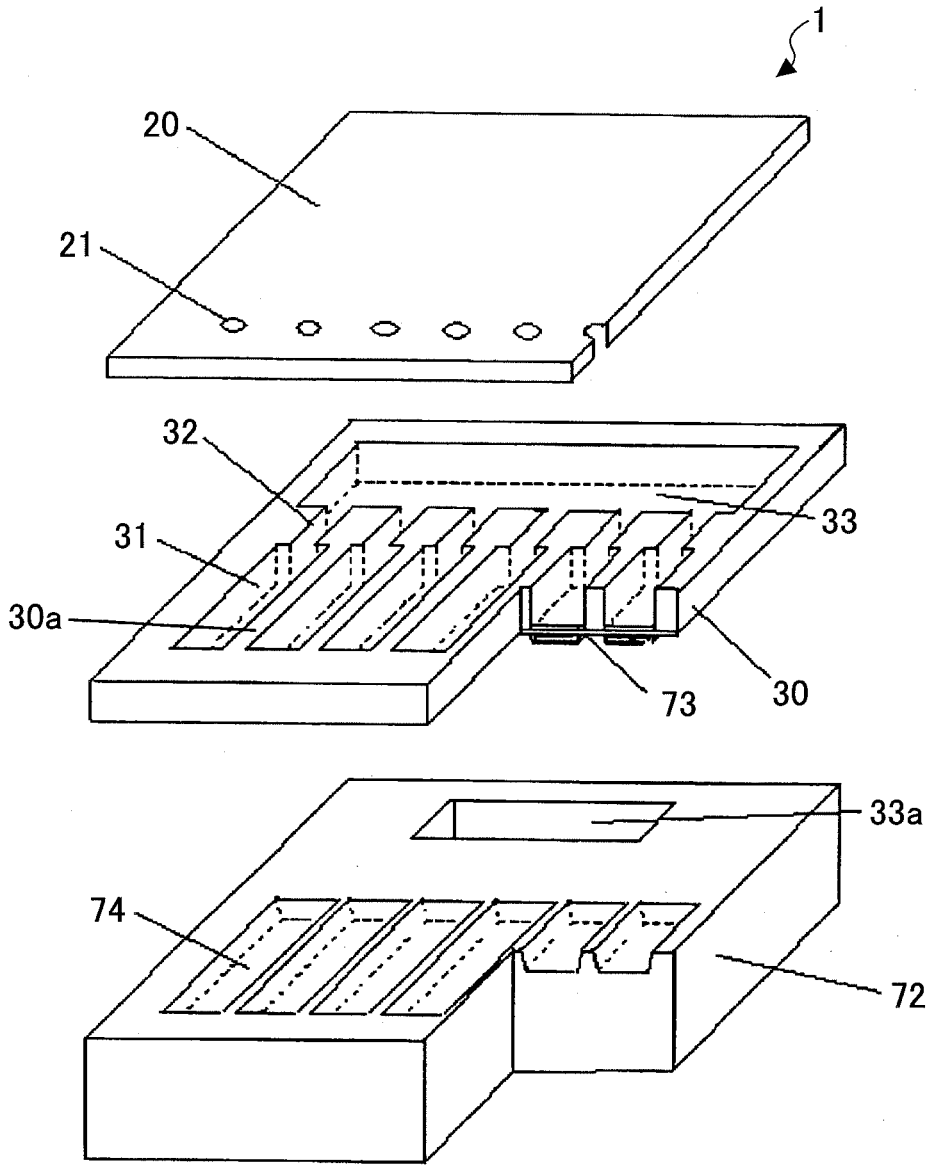
FIG. 1 is a perspective view illustrating a configuration of an inkjet head according to an embodiment.

For an inkjet head for which the MEMS technique is adopted, actuators can be produced by forming piezoelectric elements on an oscillation plate formed by thin-film technology. Here, the piezoelectric elements are produced by photolithographically patterning electrodes and piezoelectric materials formed on the oscillation plate. The electrodes and the piezoelectric materials are formed on the oscillation plate by the thin-film technology. In such a case, in order to apply the semiconductor processing technique for patterning the piezoelectric elements, thickness of the piezoelectric material is limited up to several μm. Further, a process using plasma, such as a plasma CVD technique or dry etching is commonly applied for forming or etching of electrodes (which are included in the piezoelectric elements), electrode wirings (which may be required for the device) and insulator films. When the piezoelectric elements are exposed to the plasma, the piezoelectric materials are reduced by the reduction effect of, for example, hydrogen, which is generated during the processing. Further, it is generally known that the characteristic of the piezoelectric elements are degraded by moisture in the air, in addition to the above described plasma processing.

As a countermeasure against the above problems, Patent Document 2 (Japanese Published Unexamined Application No. 2010-042683) and Patent Document 3 (Japanese Patent No. 4371209) disclose techniques for covering a portion of a piezoelectric element or the whole surface the piezoelectric element with a protective film. Patent Document 2 discloses that, when a piezoelectric element is coated with an inorganic amorphous material, moisture is prevented from entering the piezoelectric element, and the reliability of the piezoelectric material can be improved. Further, when lead electrodes to be formed on the inorganic amorphous material is extended from upper electrodes through contact holes and are connected to a driving circuit, an electrode material which can be easily corroded, such as Al, can be used as a less expensive material for wiring, if the lead electrodes are covered with an insulator film (which is different from the inorganic amorphous material). Further, when the lead electrodes are extended above the inorganic amorphous material, the lead electrodes can be overlapped with a lower electrode (common electrode). However, since the inorganic amorphous material covers the whole pattern area including the piezoelectric elements, if the inorganic amorphous material is formed to be a thick film, the inorganic amorphous material significantly prevents deformations of the piezoelectric elements. Thus the discharging performance is greatly lowered. On the other hand, when the inorganic amorphous material is formed to be a thin film so as to ensure certain amounts of deformations of the piezoelectric elements, voltage resistance between the lead electrodes and the lower electrode can be insufficient. Consequently, the electrodes are arranged so that the lead electrodes do not overlap with the lower electrode. Thus there is a problem that downsizing and higher integration of the head are difficult. For a device produced by semiconductor processing, high integration of an element, namely, the number of chips that can be cut out from one wafer is an important factor, since the number of the chips affects the production cost.

Further, Patent Document 3 discloses a technique such that, as an insulator film formed on a piezoelectric element, an inorganic material and an organic material are laminated. Specifically, end portions of the piezoelectric element, where moisture tends to enter, are covered with an inorganic material. At the same time, an opening is provided above an upper electrode. With such a configuration, a restricted amount of the oscillation displacement is minimized and a moisture-proof property is ensured. Further, Patent Document 3 discloses that the reliability of the device can be ensured by covering the whole surface of the piezoelectric element with a soft organic material. In such a configuration, since two insulator film layers are formed on the piezoelectric material, the oscillation displacement tends to be prevented. Further, in order to ensure sufficient voltage resistance with an insulator film formed of an organic material, it may be necessary that the insulator film be a thick film, compared to an insulator film formed of a general inorganic material. Additionally, since the adhesiveness of an insulator film formed of an organic material with respect to an electrode material is small, it is difficult to form lead electrodes on an organic material. Therefore, the lead electrodes are formed between an inorganic material (insulator film) and an organic material (insulator film). However, with such a configuration, as described above, the lower electrode may not be overlapped with the lead electrodes (or, thickness of the inorganic material film may be so large that the inorganic material film significantly lowers amounts of displacements of the piezoelectric elements). Therefore, higher integration of the head is difficult.

An embodiment of the present invention is developed in view of the above problems. An objective of the embodiment is to provide an inkjet head that can be downsized while maintaining high reliability (moisture resistance) and a high discharging performance, and an image forming device which utilizes the inkjet head.

Figure 2:
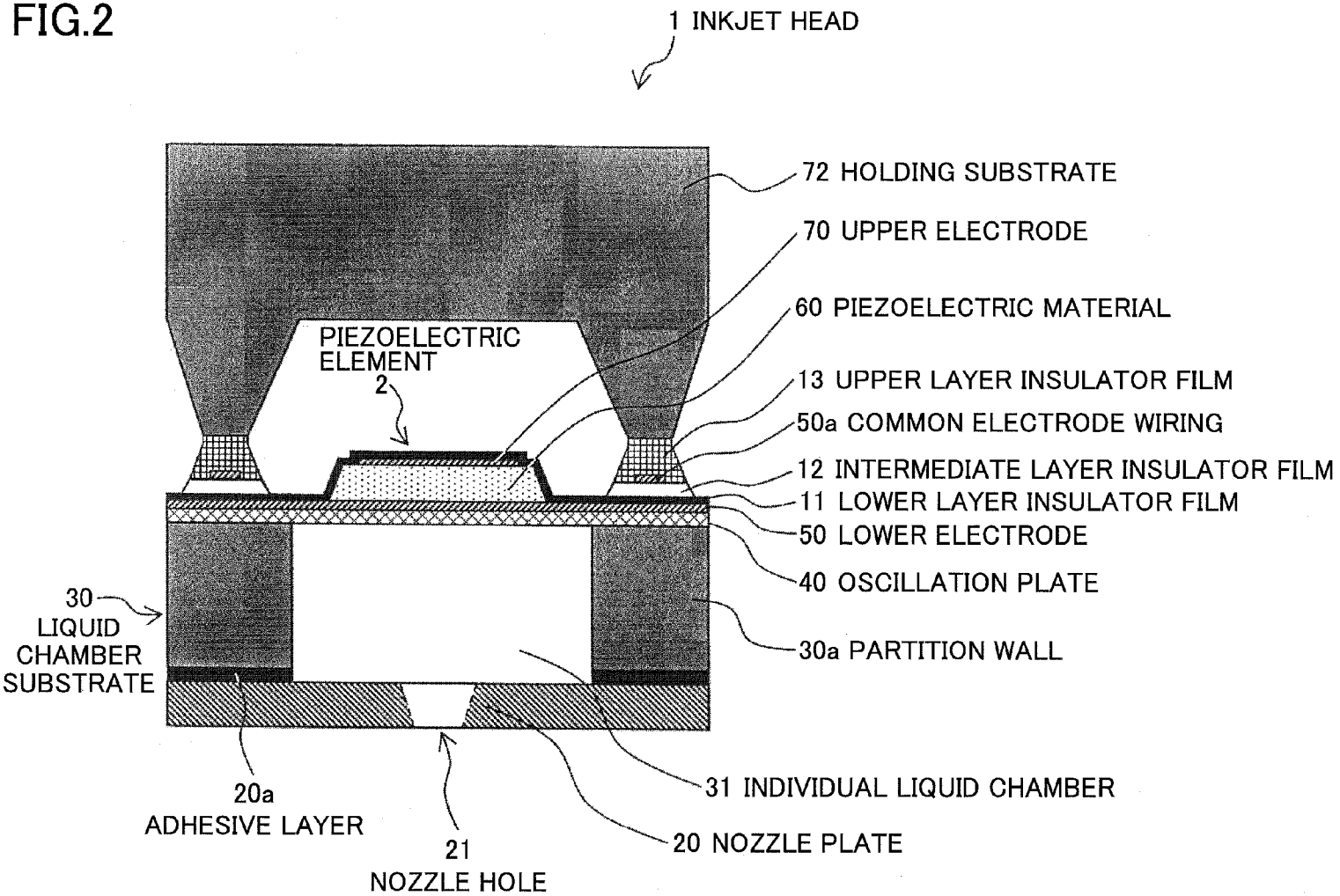
FIG. 2 is a sectional view illustrating the configuration of the inkjet head according to the embodiment in a width direction.

Hereinafter, a configuration of an inkjet head according to the embodiment is explained. FIG. 1 is an exploded perspective view that shows a cross section of a portion of the inkjet head according to the embodiment. FIG. 2 is a sectional view illustrating the configuration of the inkjet head in a width direction. As shown in FIGS. 1 and 2, the inkjet head 1 is formed to have a laminated structure, in which three substrates are laminated. The three substrates are a nozzle plate 20, a liquid chamber substrate 30, and a holding substrate 72. The nozzle plate 20 has nozzle holes 21 for discharging ink. The liquid chamber substrate 30 includes plural individual liquid chambers 31, an oscillation plate 40, and a flexible printed circuit board (FPC) 73, on which piezoelectric elements 2 and drive circuits for driving piezoelectric materials 60 are formed. On the holding substrate 72, piezoelectric element-protecting spaces 74 are formed.

The liquid chamber substrate 30 includes the oscillation plate 40. The oscillation plate 40 is formed of a laminated film on a Si substrate. The oscillation plate 40 in the embodiment is formed by laminating a silicone oxide film, a silicone active layer, and a silicone oxide film on one surface of the Si substrate, using a SOI substrate. Further, the plural piezoelectric elements 2 are arranged on the oscillation plate 40. Furthermore, plural individual liquid chambers 31 corresponding to the plural piezoelectric elements 2, respectively, plural fluid resistance portions for supplying liquid to the corresponding individual liquid chambers 31, and a common liquid chamber 33 are formed on the oscillation plate 40.

The nozzle plate 20 is a nickel substrate formed to have a thickness of 20 μm by high-speed nickel electroforming. The nozzle plate 20 has nozzle holes 21 that communicate with the corresponding individual liquid chambers 31 on the surface of the liquid chamber substrate 30.

The holding substrate 72 is a substrate, on which the piezoelectric element-protecting spaces 74 and an ink supply unit 33*a* are formed. Here, the piezoelectric element-protecting spaces 74 are for protecting the piezoelectric elements 2 and for not preventing deformations of the piezoelectric elements 2. The ink supply unit 33*a* is for supplying ink, being liquid droplets from outside, to the common liquid chamber 33.

Further, each of the individual liquid chambers 31 is a space surrounded by the oscillation plate 40, wall surfaces of the liquid chamber substrate 30, and the nozzle plate 20 having the nozzle hole 21 corresponding to the individual liquid chamber 31.

Further, on the surface of the oscillation plate 40 opposite to the individual liquid chambers 31, the piezoelectric elements 2 are formed. Here, each of the piezoelectric elements 2 is formed by laminating a lower electrode 50, the piezoelectric material 60, and an upper electrode 70. Furthermore, a surface of each of the individual liquid chambers 31 facing the oscillation plate 40 is the nozzle plate 20.

In the inkjet head 1 configured as described above, when the individual liquid chambers 31 are filled with, for example, a recording liquid (ink), an oscillation circuit applies a pulse voltage of 20V to the upper electrode 70 corresponding to the nozzle hole 21, from which the recording liquid is to be discharged, based on image data from a control unit (not shown). When the pulse voltage is applied to the upper electrode 70, by electrostriction, the piezoelectric material 60 shrinks in a direction parallel to the oscillation plate 40. Then the oscillation plate 40 bends such that the oscillation plate 40 is convex toward the side of the individual liquid chamber 31. With this, pressure inside the individual liquid chamber 31 rapidly increases, and the recording liquid is discharged from the nozzle hole 21, which communicates with the individual liquid chamber 31. Next, after the pulse voltage has been applied, since the shrunk piezoelectric material 60 returns to the original state, the bent oscillation plate 40 also returns to the original state. Thus the pressure inside the individual liquid chamber 31 becomes negative compared to the pressure inside the common liquid chamber 33. Therefore, the recording liquid is supplied from the common liquid chamber 33 to the individual liquid chamber 31 through a fluid resistance portion 32. By repeating the above operational controls, the inkjet head 1 can continuously discharge liquid droplets. Thus the inkjet head 1 can form an image on a recording medium (recording paper) placed to face the inkjet head 1.

Figure 3:
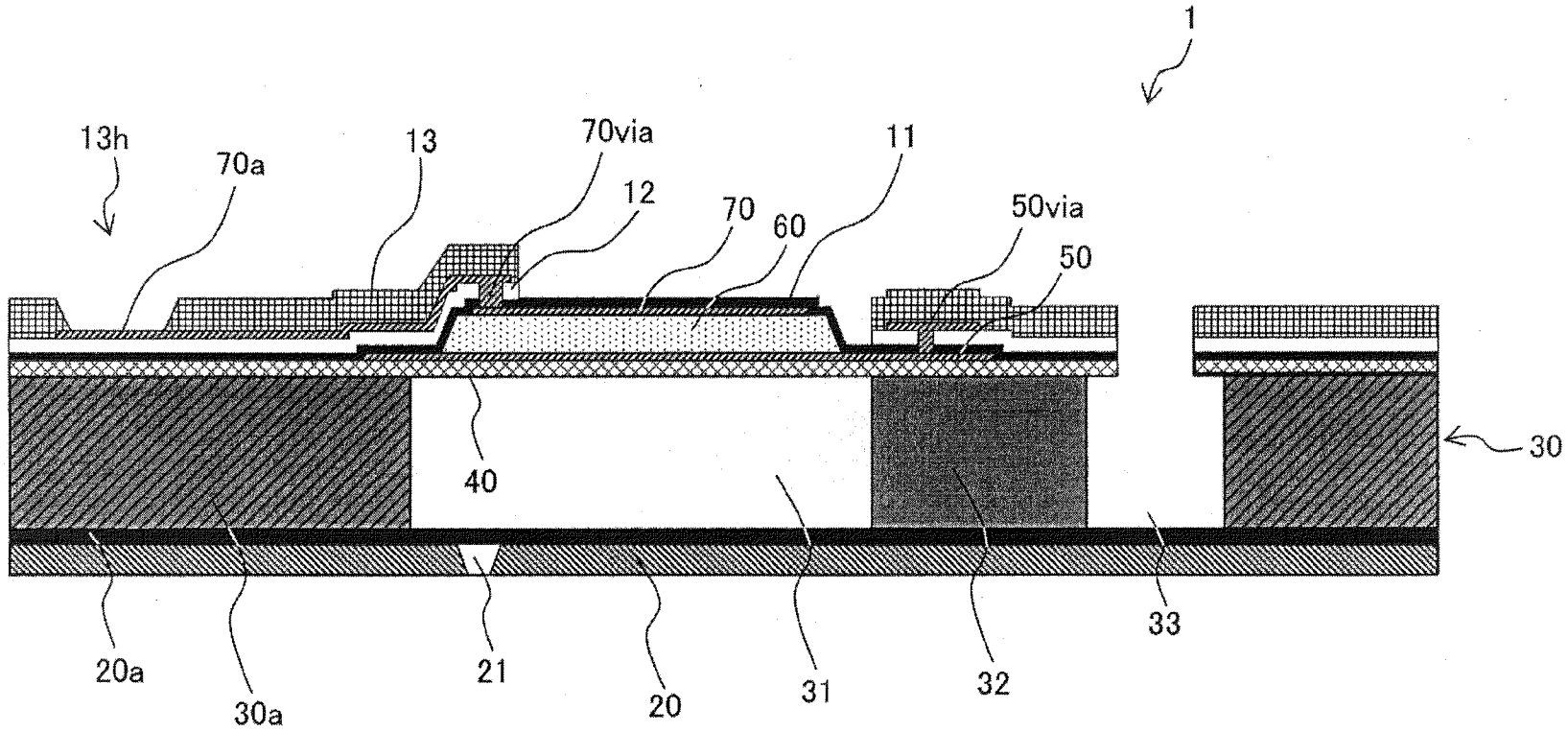
FIG. 3 is a sectional view illustrating the configuration of the inkjet head of FIG. 2 in a longitudinal direction.
Figure 4:
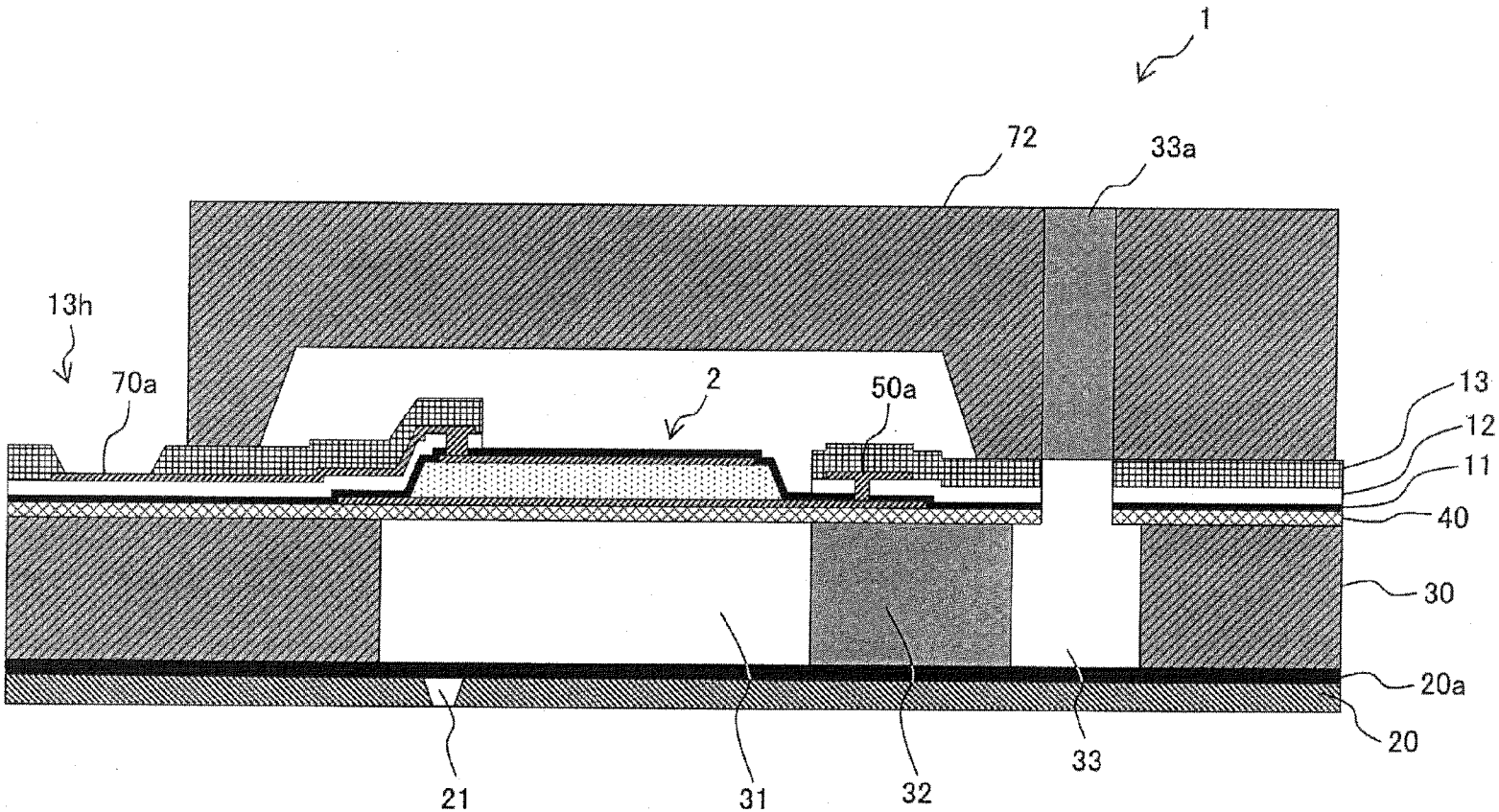
FIG. 4 is a sectional view illustrating the configuration of the inkjet head of FIG. 2 in the longitudinal direction.

Configurations of major portions of the inkjet head according to the embodiment are explained by referring to FIGS. 2-4. FIG. 2 is a sectional view illustrating a configuration of the inkjet head 1 according to the embodiment in a width direction. FIGS. 2 and 4 are sectional views illustrating configurations of the inkjet head 1 according to the embodiment in a longitudinal direction. Further, FIG. 3 shows the configuration of the inkjet head 1 prior to arranging the holding substrate 72, and FIG. 4 shows the configuration of the inkjet head 1 after the holding substrate 72 has been arranged. Here, FIGS. 2-4 show the single individual liquid chamber 31. However, as shown in FIG. 1, the individual liquid chambers 31 are divided by partition walls 30*a*. In FIG. 2, the plural individual liquid chambers 31 are arranged in the left and right direction. In FIGS. 3 and 4, the plural individual liquid chambers 31 are arranged in a direction perpendicular to the plane of the paper.

As shown in FIGS. 2-4, the inkjet head 1 includes the oscillation plate 40 formed on the Si substrate and the piezoelectric elements 2 in which the lower electrode 50, the piezoelectric materials 60, and the upper electrodes 70 are laminated on the oscillation plate 40 in this order. The inkjet head 1 is a side-shooter type head such that the piezoelectric actuator including the piezoelectric elements 2 and the oscillation plate 40 causes liquid droplets to be discharged from the nozzle holes 21, which are liquid discharging holes arranged on the substrate surface portion of the nozzle plate 20.

The nozzle plate 20 is formed of a metal, such as Steel Use Stainless (SUS), Ni, Si, an inorganic material, or a resin material, such as Polyimide (PI). On the nozzle plate 20, nozzle holes 21 are formed. The nozzle plate 21 is joined to the liquid chamber substrate 30 by an adhesive (not shown) or by another joining method, such as an anode bonding method.

The liquid chamber substrate 30 is made of the Si substrate that can be easily processed. The Si substrate is a material having sufficient mechanical strength and chemical resistance. When the Si substrate is used, so-called semiconductor processes can be used for photolithography processes and for etching processes. Thus a higher integration for the arrangement of the liquid chambers is possible.

For the oscillation plate 40, a material that elastically deforms within a range of deformation of the piezoelectric elements 2 may be used. As a material of the oscillation plate 40, a thin film made of an inorganic material or an organic material may be used. Considering adhesiveness with respect to the electrode, the inorganic material is preferable. As the inorganic material, an arbitrary material, such as a metal, an alloy, a semiconductor, or a dielectric material, may be used. For the material of the oscillation plate 40, an optimum material can be selected based on a processing method. When Si is used for the liquid chamber substrate 30, it is preferable to use $SiO_2$, $Si_3N_4$, or another Si crystal. In general, a thermally-oxidized film of Si is used. Further, when these materials are laminated to form a film, a residual stress may be cancelled out by the structure. Further, a dielectric material, such as $SiO_2$, or $Si_3N_4$, is chemically stable. Thus, even if the dielectric material contacts a discharged ink, the dielectric material can prevent the oscillation plate 40 from collapsing by corrosion caused by the ink. Further, the techniques for forming these thin films are the techniques that have been established for the semiconductor processing. Therefore, a stable oscillation plate 40 can be obtained.

It is preferable that the thickness of the oscillation plate 40 be optimized based on the stiffness of the material and the method of forming the material. When the above described inorganic materials ($SiO_2$, $Si_3N_4$) are used, it is preferable that the thickness be within a range from 1 μm to 5 μm. For example, firstly, an insulator, which becomes the oscillation plate 40, is formed on the Si substrate. Subsequently, cavities, which become the liquid chambers, such as the individual liquid chambers 31, are formed by the etching. Then the Si substrate is polished to have desired thickness. When the etching process is performed, the insulator layer is the stop layer.

The lower electrode 50 is a common electrode for the plural piezoelectric elements 2, and the lower electrode 50 is connected to a common electrode wiring 50*a* through a common electrode contact holes 50*via*.

Further, the lower electrode 50 is a crystalline oriented thin film that controls, for example, the orientations of the piezoelectric materials 60. For a material for forming the lower electrode 50, an arbitrary conducting material can be used. For the conducting material, a metal, an alloy, or conductive compounds may be used. Based on the forming method of the film of the piezoelectric materials 60, it is preferable that, for a material of the electrode, a material having higher heat resistance be used. After forming the film of the piezoelectric material 60, a process for crystallizing the piezoelectric material 60 may be required. When lead ziroconate titanate (PZT), which is a common material as a piezoelectric material, is used, usually the temperature of crystallization process is within a range from 500 degrees Celsius to 800 degrees Celsius. Therefore, a material of the piezoelectric elements 2 may be required to have a higher melting point. At the same time, the material of the piezoelectric elements 2 may be required to be highly stable so as not to form chemical compounds with the oscillation plate 40 and the piezoelectric material, which are neighboring to the material used for the piezoelectric elements 2 at a high temperature. It is preferable that, for the material used for the piezoelectric elements 2, a metal having low reactivity and a high melting point, such as Pt, Ir, Pd, Au, or alloys thereof, be used. Among theses metals and alloys, Pt is most commonly used. The lattice constant of Pt is close to that of lead ziroconate titanate (PZT). Pt is a noble metal that is difficult to oxidize. Further, a compound conductive material having a high "high-temperature stability" may be used. For example, a conductive oxide containing a platinum group metal, such as $IrO_2$, $RuO_2$, SrO, $SrRuO_3$, $CaRuO_3$, $BaRuO_3$, or $(Sr_xCa_{1-x})RuO_3$, or $LaNiO_3$ can be considered.

Film thickness of the lower electrode 50 may be arbitrary set depending on electric resistance that the lower electrode 50 may be required to have. It is preferable that the film thickness of the lower electrode 50 be within a range from 100 nm to 1 μm. Further, an adhesive layer may be attached to the lower electrode 50 so as to increase adhesiveness with respect to the oscillation plate 40, or the lower electrode 50 may have a laminated structure such that the material of the boundary surface between the lower electrode 50 and the piezoelectric material 60 is different from that of the lower electrode 50.

As a material of the piezoelectric material 60, a complex oxide having a perovskite-type crystal structure that can be expressed by a chemical formula of $ABO_3$ may be used. Here, as an element of the A-site, an element, such as Pb, Ba, Nb, La, Li, Sr, Bi, Na, or K, can be considered. Further, as an element of the B-site, an element, such as Cd, Fe, Ti, Ta, Mg, Mo, Ni, Nb, Zr, Zn, W, or Yb can be considered. Among the complex oxides, lead ziroconate titanate (PZT) is used in many cases. In lead ziroconate titanate (PZT), lead (Pb) is used for the A-site, a mixture of zirconium (Zr) and titanium is used for the B-site. Since lead zirconate titanate (PZT) is superior in thermal property and piezoelectric property, when lead zirconate titanate (PZT) is used, highly reliable and stable piezoelectric elements 2 can be obtained. Alternatively to PZT, barium titanate ($BaTiO_3$) may be used. Barium titanate has an environmental advantage that it does not include lead. Further, an amount of displacement is large when barium titanate is used. Since barium titanate is less expensive, barium titanate is used in many cases.

As a method of forming the piezoelectric material 60, an existing arbitrary method can be used. As examples of the existing methods, the sputtering method, which is a vacuum film formation method, the spin coating method, which is a liquid phase film formation method, and the printing process can be considered. When the liquid phase film formation method is used, it is common to use a sol-gel method. In the sol-gel method, a liquid, in which an organometallic compound being a material of the film is dissolved, is dried. After that, organic matters are resolved and removed by a thermal process and the piezoelectric material 60 can be obtained. Especially, when the liquid phase film formation method is used, a facility and process for forming a film is simplified. Thus a high-quality piezoelectric material can be easily obtained. The piezoelectric material 60 formed according to any of the above described processes usually has an amorphous structure, and does not demonstrate piezoelectricity. However, after a thermal process (500 degrees Celsius to 750 degrees Celsius) is applied, the amorphous structure is crystallized and polarized. Thus the piezoelectric material 60 demonstrates piezoelectricity. The thickness of the film of the piezoelectric material 60 can be set to an optimum value depending on a desired property. However, it is preferable that the thickness be within a range from 0.1 μm to 5 μm.

Further, the piezoelectric material 60 may be separately formed for the corresponding individual liquid chamber 31. The width of the piezoelectric material 60 may be smaller than the width of the individual liquid chamber 31. When the piezoelectric material 60 is separately formed for the corresponding individual liquid chamber 31 and the width of the piezoelectric material 60 is smaller than the width of the individual liquid chamber 31, high rigidity portions, on which the film of the piezoelectric material 60 is not formed, are formed above the individual liquid chamber 31, and areas which vibrate and displace are ensured. When the piezoelectric material 60 is formed on the whole surface, since the amount of the vibration displacement is reduced, a higher driving voltage may be required to obtain a desired performance.

For the patterning of the piezoelectric materials 60 (separation of the piezoelectric materials 60 corresponding to the individual liquid chambers), an existing processing method may be used. When the photolithography, which is common in the fabrication process of a semiconductor, is used as the existing processing method, highly accurate patterning is possible. Further, when the liquid phase film formation method is used, a direct patterning using the printing process is possible. As examples of the printing process, a printing process using a block, such as a gravure printing method, a flexographic printing method, a screen printing method, and a printing process without using a block, such as an inkjet method, can be considered.

The upper electrodes 70 are formed above the piezoelectric materials 60 being formed corresponding to the individual liquid chambers 31. Further, each of the upper electrodes 70 is an individual electrode corresponding to one of the plural piezoelectric elements 2. Each of the upper electrodes 70 is connected to a corresponding individual electrode wiring 70*a* through a corresponding individual electrode contact hole 70*via*. Each of the individual electrode wirings 70*a* is individually conductively connected to the corresponding one of the plural upper electrodes 70 corresponding to the piezoelectric elements 2. Driving signals are input to the corresponding piezoelectric elements 2 from a driving signal input unit (not shown) through the corresponding individual electrode wirings 70*a*.

As a material of the upper electrodes 70, any of the materials similar to the materials of the lower electrode 50 may be used. Namely, an arbitrary conductive material can be used as a material of the upper electrodes 70. As a conductive material, a metal, an alloy, or a conductive compound can be considered. However, a metal or an alloy is preferable. For the selection of the material of the upper electrodes 70, adhesiveness with respect to the piezoelectric material 60 may be considered. Further, a material that reacts and interdiffuses with the material included in the piezoelectric material 60, such as Pb, and that forms an alloy is not preferable. Further, a material that reacts with oxygen or the like included in the piezoelectric material 60 is not preferable. Therefore, it is preferable to use a stable material, whose reactivity is low. As examples of the above materials, materials such as Au, Pt, Ir, Pd, an alloy thereof or a solid solution thereof, can be considered.

Further, it is preferable that the width of the upper electrode 70 be smaller than the width of the piezoelectric material 60. If the upper electrode 70 is formed to cover the end portions of the piezoelectric material 60, a short may occur between the lower electrode 50 and the upper electrode 70. In such a case, the reliability of the piezoelectric elements 2 is significantly lowered.

The inkjet head 1 according to the embodiment includes an upper layer insulator film 13 that covers at least a surface of the common electrode wiring 50*a* and surfaces of the individual electrode wirings 70*a*; an intermediate layer insulator film 12 provided between the individual electrode wirings 70*a* and the lower electrode 50 at least on areas where the individual electrode wirings 70*a* and the lower electrode 50 overlap, the intermediate layer insulator film 12 being a lower layer of the upper layer insulator film 13; and a lower layer insulator film 11 that covers at least surfaces of the piezoelectric materials 2, the lower layer insulator film 11 being a lower layer of the intermediate insulator layer. Here, the intermediate layer insulator film 12 and the upper layer insulator film 13 have openings to expose the piezoelectric elements 2. Hereinafter, the lower layer insulator film 11, the intermediate layer insulator film 12, and the upper layer insulator film 13 are explained.

(Lower Layer Insulator Film 11)

As shown in FIGS. 2-4, the lower layer insulator film 11 is an insulator layer that covers the whole surface of the board surface (the oscillation plate 40) including the piezoelectric elements 2. In the manufacturing process, the lower layer insulator film 11 is the first layer to be formed among the lower layer insulator film 11, the intermediate layer insulator film 12, and the upper layer insulator film 13. Further, the lower layer insulator film 11 has openings only at the common electrode contact hole 50*via* for extending the common electrode from the lower electrode 50 and at the individual electrode contact holes 70*via* for extending the individual electrodes from the upper electrodes 70. The lower layer insulator film 11 has a structure that covers other portions where the oscillation plate 40 is formed.

The piezoelectric elements 2 formed of the lower electrode 50, the piezoelectric materials 60, and the upper electrode 70 can be damaged by two factors. One is a factor of the manufacturing process. The other one is a factor of the usage environment of the device. However, the lower layer insulator film 11 has a function to protect the piezoelectric elements 2 from damage.

The factor of the manufacturing process which causes damage to the piezoelectric elements 2 is caused by the film forming process and the etching process. Namely, the forming process of the inkjet head 1 includes processes of forming and patterning the intermediate layer insulator film 12, which is an interlayer insulator film for insulating the individual electrode wirings 70*a* and the lower electrode 50, and the upper layer insulator film 13, which is a wiring protecting layer for protecting the common electrode wiring 50*a* and the individual electrode wirings 70*a*. The sputtering method or the plasma CVD technique may be applied to form the insulator films, but the piezoelectric elements 2 can be damaged by the generated plasma. Specifically, the piezoelectric materials 60 are reduced by the reduction effect of hydrogen ions included in the plasma, and the piezoelectricity and voltage resistance of the piezoelectric materials 60 are lowered. Further, for patterning the film of wiring being formed, usually the photolithographic method is used. Especially, when the patterning is performed by the dry etching method using the plasma, it is possible that the piezoelectric materials 60 are damaged by the etching gas, which has become plasma, similar to the above cases in which the insulator films are formed.

Further, the moisture (humidity) in the air can be a factor on the usage environment of the device. Especially, since an inkjet device which uses an aqueous ink tends to be exposed to a high-humidity environment, the moisture in the atmosphere in the device enters inside the piezoelectric materials 60 and a failure occurs such that the piezoelectric materials 60 are damaged. Consequently, the voltage resistance of the piezoelectric elements 2 is degraded and shorts occur, and the driving durability of the inkjet head is lowered.

Therefore, in the embodiment, in order to prevent the damages of the piezoelectric elements 2 caused by the factor of the manufacturing process or the factor of the usage environment of the device from occurring, the lower layer insulator film 11 is provided as a layer for protecting the piezoelectric material 60.

For the material of the lower layer insulator film 11, a material may be selected such that the above described plasma or the moisture in the air does not easily pass through the material. Thus a dense inorganic material may be used. Here, an organic material is not suitable as the material of the lower layer insulator film 11. When an organic material is used as the material of the lower layer insulator film 11, the thickness of the lower layer insulator film 11 may be greater in order to obtain a sufficient protection. In such a case, the lower layer insulator film 11 prevents the oscillation deformation of the oscillation plate 40, and the discharging performance of the inkjet head 1 is lowered.

Further, in order to obtain a high protection performance while maintaining the fine thickness of the lower layer insulator film 11, it is preferable that an oxide, a nitride, or a carbonized film be used. Additionally, a material having a higher adhesiveness with respect to the materials of the lower electrode 50 and the upper electrode 70, the material of the piezoelectric material 60 and the material of the oscillation plate 40 may be selected. Here, the lower electrode 50, the upper electrode 70, the piezoelectric material 60, and the oscillation plate 40 are the base of the lower layer insulator film 11. Further, for a method of forming the lower layer insulator film 11, a method that does not damage the piezoelectric materials 2 may be selected. Namely, the plasma CVD method, in which a reactive gas is plasmatized and the plazmatized reactive gas is accumulated on a substrate, and the sputtering method, in which plasma is collided with a target material and is deposited so as to form a film, are not preferable. Examples of the preferred method of forming the lower layer insulator film 11 include an evaporation method and an atomic layer deposition (ALD). Since a wider range of materials can be used, the ALD is preferable. Examples of the preferable material of the lower layer insulator film 11 include thin films formed of inorganic materials (ceramic materials) including at least one of $Al_2O_3$, $ZrO_2$, $Y_2O_3$, $Ta_2O_5$, and $TiO_2$.

The thickness of the lower layer insulator film 11 may be sufficiently large so that the performance for protecting the piezoelectric elements 2 is ensured. At the same time, the thickness of the lower layer insulator film 11 may be sufficiently small so that the lower layer insulator film 11 does not prevent the deformation of the oscillation plate 40. A preferred range of the thickness of the lower layer insulator film 11 is from 20 nm to 100 nm. When the thickness of the lower layer insulator film 11 is greater than 100 nm, the deformation of the oscillation plate 40 is degraded and the discharging efficiency of the inkjet head 1 is lowered. On the other hand, when the thickness of the lower layer insulator film 11 is smaller than 20 nm, the function of the lower layer insulator film 11 as the layer of protecting the piezoelectric elements 2 is insufficient, and the performance of the piezoelectric elements 2 is lowered.

(Intermediate Layer Insulator Film 12)

As shown in FIG. 3, in the inkjet head 1 according to the embodiment, each of the upper electrodes 70 is extended as an individual electrode through the corresponding individual electrode contact hole 70*via* and connected to the corresponding individual electrode wiring 70*a*. Further, there is an area where the extended individual electrode wiring 70*a* and the lower electrode 50 overlap. Here, the lower electrode 50 is coated with the lower layer insulator film 11. However, since the thickness of the lower layer insulator film 11 is small as described above, with the lower layer insulator film 11, sufficient voltage resistance is not ensured in the area where the individual electrode wiring 70*a* and the lower electrode 50 overlap. Therefore, in the embodiment, the intermediate layer insulator film 12 is provided in the area. The intermediate layer insulator film 12 is provided between the individual electrode wiring 70*a* and the lower electrode 50 so as to insulate the individual electrode wiring 70*a* from the lower electrode 50 and to ensure the voltage resistance. For example, in the area where the individual electrode wiring 70*a* is formed, the intermediate layer insulator film 12 may be formed as a lower layer of the individual electrode wiring 70*a*. Here, the individual electrode wiring 70*a* is formed between the intermediate layer insulator film 12 and the upper layer insulator film 13.

As a material for the intermediate layer insulator film 12, an arbitrary insulator material may be used. However, taking into consideration the adhesiveness of the intermediate layer insulator film 12 with respect to the individual electrode wiring 70*a*, which is formed above the intermediate layer insulator film 12, an inorganic material is preferable. As an inorganic material, an arbitrary oxide, nitride, carbide, or a complex compound thereof may be used. However, it is preferable to use $SiO_2$, which is commonly used in a semiconductor device. Further, as a method for forming the intermediate layer insulator film 12, an arbitrary method may be used. For example, the CVD method or the sputtering method may be used. However, taking into consideration the stepwise coating of portions where patterns are formed, such as a portion where the electrode is formed, it is preferable to use the CVD method, with which the film can be formed isotropically.

The thickness of the intermediate layer insulator film 12 may be set so as to prevent an electric breakdown of the intermediate layer insulator film 12 from occurring. In other words, the strength of the electric field applied to the intermediate layer insulator film 12 may be regulated within a range where the electric breakdown of the intermediate layer insulator film 12 does not occur. Further, taking into consideration the surface property and the pinholes of the base of the intermediate layer insulator film 12, the thickness of the intermediate layer insulator film 12 may be greater than or equal to 200 nm. It is preferable that the thickness of the intermediate layer insulator film 12 is greater than or equal to 500 nm. Further, taking into consideration of the time for forming and the time for processing the intermediate layer insulator film 12, it is preferable that the thickness of the intermediate layer insulator film 12 is less than or equal to 2000 nm. When the thickness of the intermediate layer insulator film 12 is greater than 2000 nm, the time for forming and for processing the intermediate layer insulator film 12 is lengthened. Thus the productivity is lowered. Additionally, since the time during which the piezoelectric elements 2 being produced are exposed to plasma is lengthened, the lower layer insulator film 11 is damaged. Thus the performance of the piezoelectric element 2 is degraded.

Further, as shown in FIG. 2, the intermediate layer insulator film 12 has openings for exposing the piezoelectric elements 2. Since the intermediate layer insulator film 12 corresponding to the areas where the amount of the deformation of the oscillation plate 40 can be regulated is removed, even if the thickness of the intermediate layer insulator film 12 is sufficiently large for ensuring the voltage resistance, the influence of the intermediate layer insulator film 12 on the deformation of the oscillation plate 40 can be reduced. Thus both the discharging efficiency and the reliability can be improved. Further, since the piezoelectric elements 2 are protected by the lower layer insulator film 11, the photolithography and the dry etching method can be used for forming the openings of the intermediate layer insulator film 12.

In this manner, the lower electrode 50 and the individual electrode wirings 70*a* can be overlapped through the intermediate layer insulator film 12. Thus the degree of freedom of the arrangement of the electrodes is increased. Further, the degree of freedom of the patterning of the wirings is increased. Therefore, an efficient pattern arrangement of the electrodes and the wirings is possible. Namely, the downsizing and the higher integration of the inkjet head 1 are possible.

(Upper Layer Insulator Film 13)

The upper layer insulator film 13 is a passivation layer that functions as a protecting layer for protecting the common electrode wiring 50*a* and the individual electrode wirings 70*a*. As shown in FIG. 4, the upper layer insulator film 13 covers the common electrode wiring 50*a*, except for a portion where the common electrode wiring is extending (not shown), and the individual electrode wirings 70*a*, except for the portions 13*h* where the individual electrode wirings 70*a* are extending. Further, the upper layer insulator film 13 is formed above the intermediate layer insulator film 12. With this configuration, the common electrode wiring 50*a* and the individual electrode wirings 70*a* are protected from corrosion in the usage environment of the inkjet head 1. Thus Al or an alloy material, which is composed primarily of Al, can be used as materials of the common electrode wiring 50*a* and the individual electrode wirings 70*a*. Here, Al and the alloy material, which is composed primarily of Al, are less expensive. Consequently, a low-cost and highly reliable inkjet head can be realized.

As a material of the upper layer insulator film 13, an arbitrary organic material or an arbitrary inorganic material may be used. The material of the upper layer insulator film 13 may have low moisture permiability. Examples of the inorganic material include oxide, nitride, and carbide. Examples of the organic material include polyimide, an acrylic resin, and an urethane resin. However, when an organic material is used as the material of the upper layer insulator film 13, the upper layer insulator film 13 may be a thick film. Thus an organic material is not suitable for the patterning described later. Therefore, as a material of the upper layer insulator film 13, an inorganic material is preferable. A thin film formed of an inorganic material can provide a function to protect wirings. Especially, it is preferable to use $Si_3N_4$ on Al wirings. The use of $Si_3N_4$ on Al wirings is a proven technique for semiconductor devices.

Further, it is preferable that the thickness of the upper layer insulator film 13 be greater than or equal to 200 nm, and it is more preferable that the thickness of the upper layer insulator film 13 be greater than or equal to 500 nm. When the thickness of the upper layer insulator film 13 is small, the upper layer insulator film 13 does not provide a sufficient passivation function. In such a case, corrosion of the wiring material may cause the common electrode wiring 50*a* and the individual electrode wirings 70*a* to disconnect. Thus the reliability of the inkjet head 1 is lowered. Here, taking into consideration the forming time and processing time of the upper layer insulator film 13, it is preferable that the thickness of the upper layer insulator film 13 be less than or equal to 2000 nm. When the thickness of the upper layer insulator film 13 is greater than 2000 nm, the time for forming and for processing the upper layer insulator film 13 is lengthened. Thus the productivity is lowered. Additionally, since the time, for which the piezoelectric elements 2 being produced are exposed to plasma, is lengthened, the lower layer insulator film 11 is damaged. Thus the performance of the piezoelectric element 2 is degraded.

Further, as shown in FIG. 2, the upper layer insulator film 13 has openings above the oscillation plate 40 so as to expose the piezoelectric elements 2. Similar to the above described openings of the intermediate layer insulator film 12, since the upper layer insulator film 13 in the areas, where the amount of the deformation of the oscillation plate 40 can be regulated, is removed, the influence of the upper layer insulator film 13 on the deformation of the oscillation plate 40 is reduced. Thus both the discharging efficiency and the reliability can be improved. With this, a highly efficient and highly reliable inkjet head 1 is realized.

Further, as shown in FIGS. 2 and 4, the inkjet head 1 has a configuration such that the holding substrate 72 is arranged on the upper layer insulator film 13, and the ink is supplied from the ink supply unit 33*a* formed in the holding substrate 72 to the individual liquid chamber 31 through the common liquid chamber 33 and the fluid resistance portion 32.

Here, as shown in FIG. 2, it is preferable that, in the vicinity of the piezoelectric element 2, the holding substrate 72 and the liquid chamber substrate 30 are joined by the partition walls 30*a*. With such a configuration, so-called "cross-talk" may be reduced. Here, the cross-talk is an effect such that, when the oscillation plate 40 in one of the individual liquid chambers 31 is driven, the oscillation plate 40 in the neighboring individual liquid chamber 31 is deformed.

As a material of the holding substrate 72, an arbitrary material may be used. However, when the Si substrate, whose material is the same as that of the liquid chamber substrate 30, is used, the difference between the coefficient of thermal expansion of the holding substrate 72 and that of the liquid chamber substrate 30 can be reduced, and warpage of the holding substrate 72 and the liquid chamber substrate 30 can be reduced.

When the above described upper layer insulator film 13, the intermediate layer insulator film 12, and the lower layer insulator film 11 are arranged, deterioration of the piezoelectric elements (piezoelectric materials 60), which is caused by the plasma in the semiconductor processing during the manufacturing process of the inkjet head 1 and by the moisture in the air in the usage environment, can be prevented. Therefore, the reliability of the piezoelectric elements 2 is improved. Further, since sufficient amounts of deformations of the piezoelectric elements 2 are ensured, the discharging efficiency of the inkjet head 1 is improved. At the same time, since there is no constraint on the arrangement between the lower electrode 50 and the individual electrode wirings 70*a*, the downsizing and the higher integration of the inkjet head 1 become possible.

Incidentally, in the configuration of the inkjet head 1 shown in FIG. 2, end portions of the deformed oscillation plate 40 in the individual liquid chamber 31 are defined by the width of the individual liquid chamber 31. Here, when the individual liquid chamber 31 is formed on the liquid chamber substrate 30 by the MEMS process, the liquid chamber substrate 30 is engraved from the lower surface in FIG. 2 using the etching method. At that time, the liquid chamber substrate 30 is processed by an anisotropic etching. Namely, a method, in which the liquid chamber substrate 30 shown in FIG. 2 is selectively etched from the lower side to the upper side, is used. However, at that time, since the liquid chamber substrate 30 is also etched in the horizontal direction, the cross-sectional shape of the individual liquid chamber 31 is not an idealistic rectangular shape, as the cross-sectional shape tends to be tapered. Therefore, the width between the end portions defining the movable area of the oscillation plate 40 tends to vary. Consequently, the discharging performance of the inkjet head 1 varies.

Figure 5:
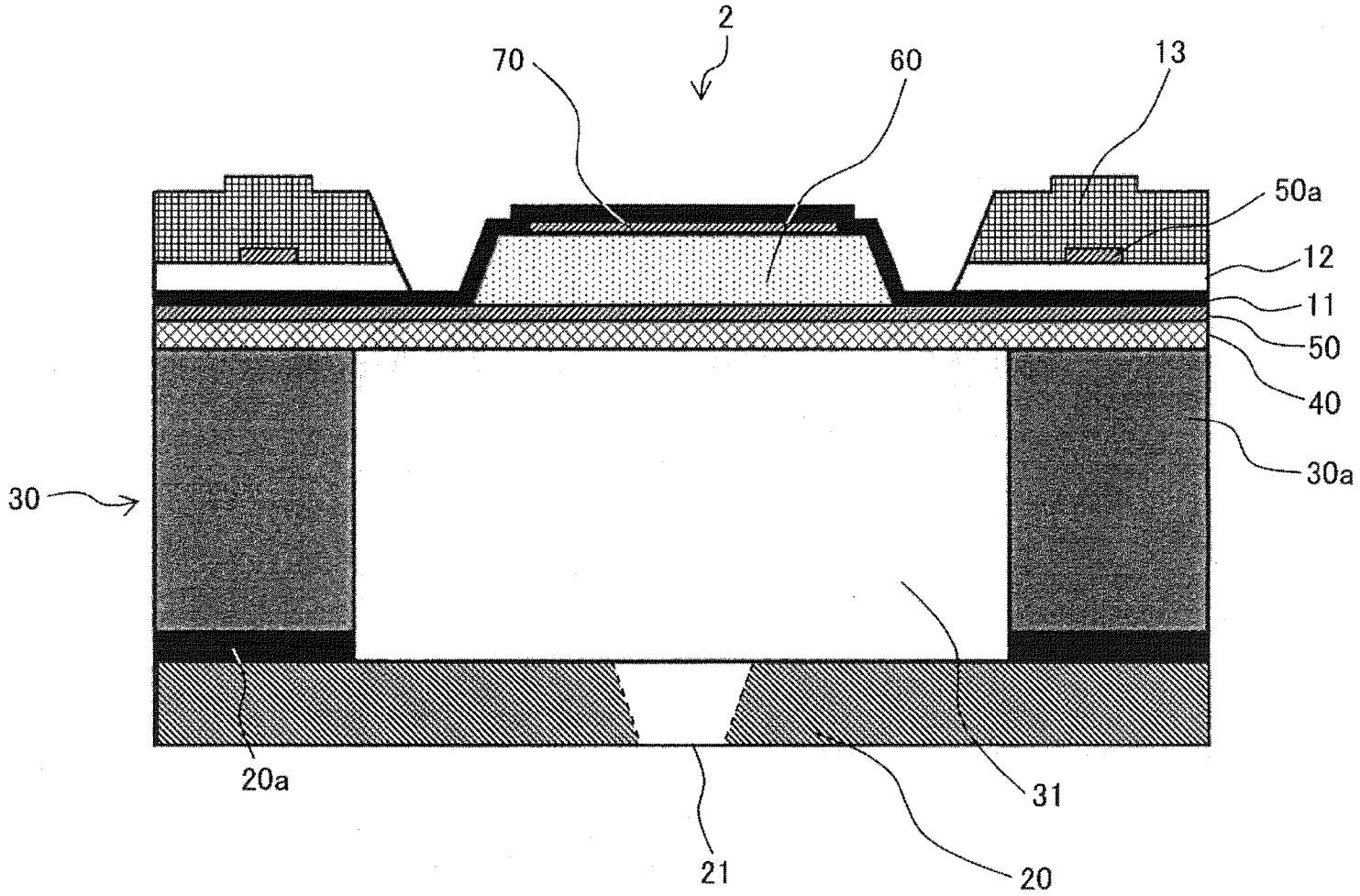
FIG. 5 is a sectional view illustrating the configuration of the inkjet head according to the embodiment in the width direction.

Accordingly, as shown in FIG. 5, it is preferable that the widths of the openings of the intermediate layer insulator film 12 and the upper layer insulator film 13 are greater than the width of the piezoelectric element 2, and are smaller than the width of the individual liquid chamber 31. Namely, the intermediate layer insulator film 12 and the upper layer insulator film 13 formed above the partition wall 30*a* for partitioning the individual liquid chamber 31 are formed to have a configuration such that the widths of the intermediate layer insulator film 12 and the upper layer insulator film 13 are greater than the width of the partition wall 30*a*, and the intermediate layer insulator film 12 and the upper layer insulator film 13 are extended toward the side of the individual liquid chamber 31.

With the above configuration, since the openings of the intermediate layer insulator film 12 and the upper layer insulator film 13 are accurately formed by the patterning, the end portions of the movable area of the oscillation plate 40 in the individual liquid chamber 31 can be accurately defined by the end portions of the intermediate layer insulator film 12 and the upper layer insulator film 13. In this manner, the variation of the characteristic of the individual liquid chamber 31 (variation of the discharging performance) can be reduced.

In this case, one of the intermediate layer insulator film 12 and the upper layer insulator film 13 may be a film having high stiffness. Especially, it is preferable that the upper layer insulator film 13, which functions as the layer protecting the electrode wiring 50*a* and the electrode wirings 70*a*, be a dense and highly rigid film. At the same time, it is preferable that the thickness of the upper layer insulator film 13 be thicker than that of the intermediate layer insulator film 12. With such a configuration, the upper layer insulator film 13 can be a reinforcement layer of the portion joining the holding substrate 72 and the liquid chamber substrate 30.

Figure 6:
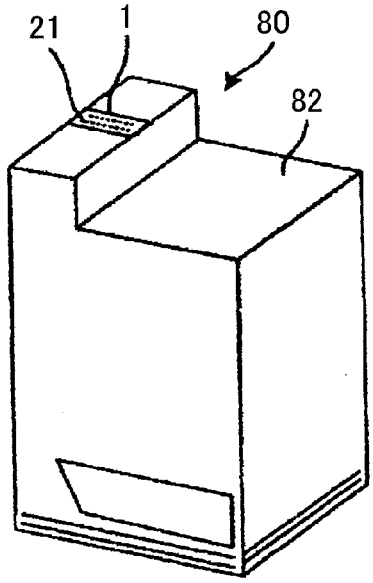
FIG. 6 is an external view of a liquid cartridge that utilizes the inkjet head according to the embodiment.

Incidentally, the inkjet head 1 may be integrated with a liquid tank for supplying a liquid, such as an ink, to the inkjet head 1 so as to form a liquid cartridge. FIG. 6 shows an external appearance of an ink cartridge 80, which is the liquid cartridge. The ink cartridge 80 is formed by integrating the inkjet head 1 having the nozzle holes 21 and the like according to the embodiment and an ink tank 82 for supplying the ink to the inkjet head 1. When the ink tank 82 is integrated with the inkjet head 1 and a highly accurate, highly dense, and highly reliable actuator unit is used, the yield rate and the reliability of the ink cartridge 80 can be improved. Therefore the cost of the ink cartridge 80 can be reduced.

Figure 7:
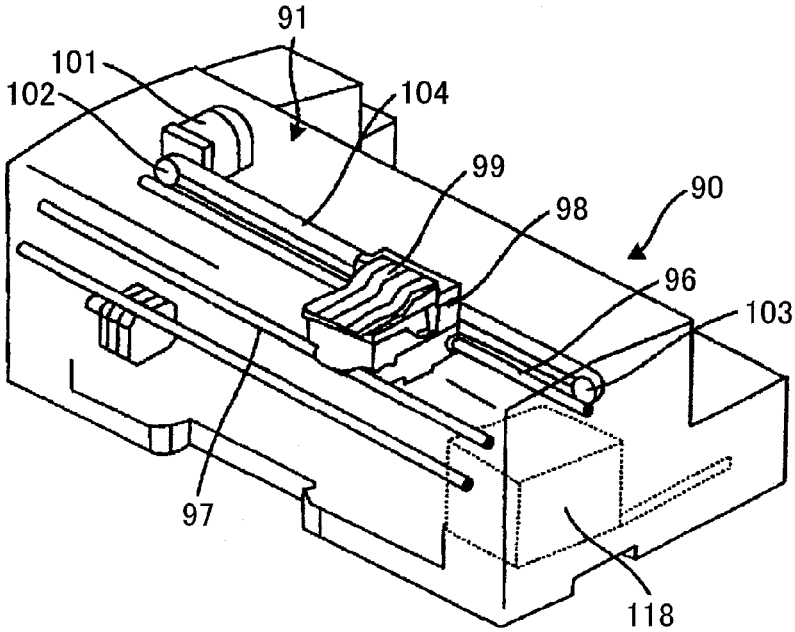
FIG. 7 is an external view of an inkjet recording device, which is an image forming device according to the embodiment.
Figure 8:
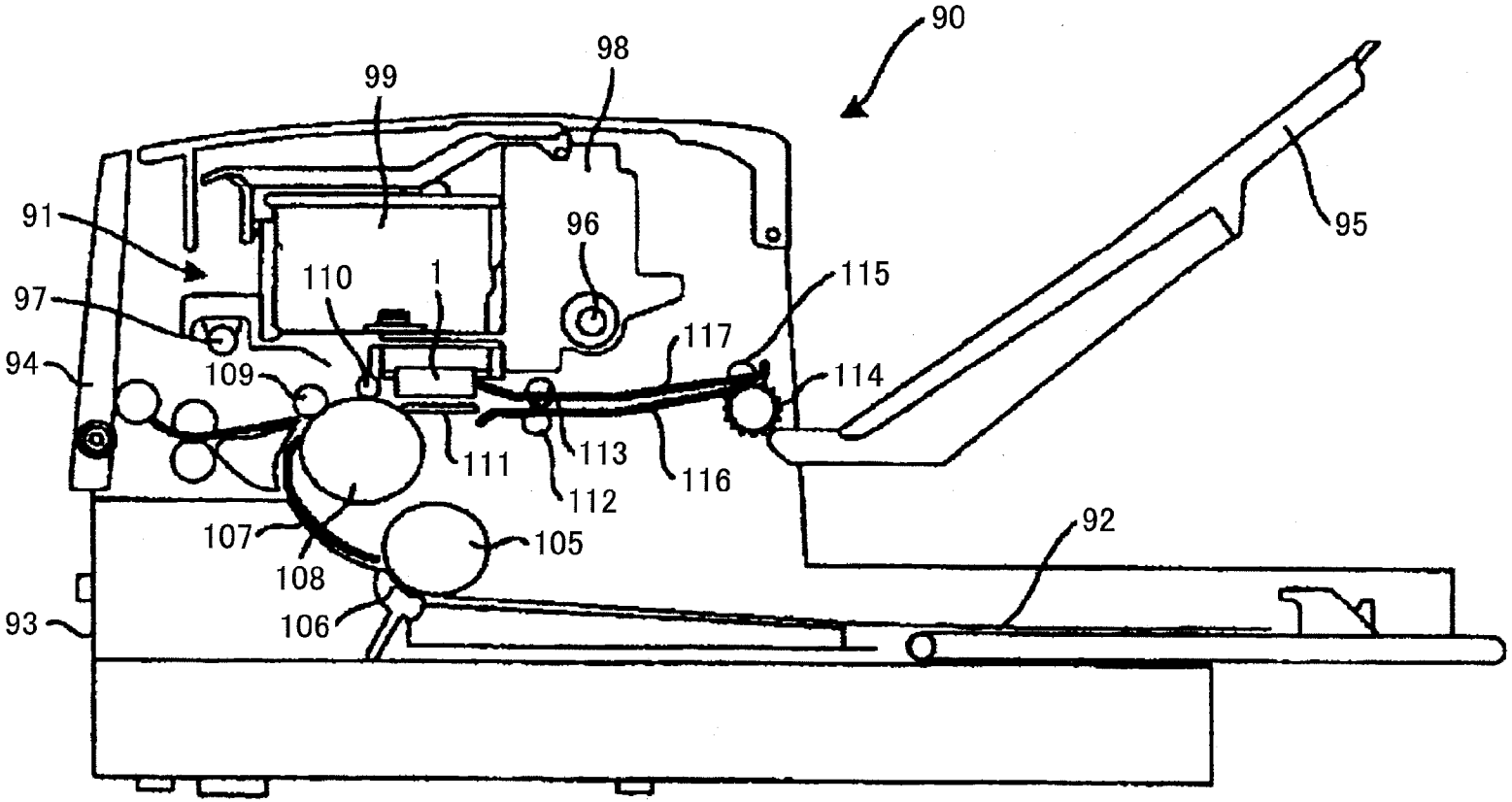
FIG. 8 is a sectional view illustrating a configuration of mechanical portions of the inkjet recording device.

Hereinafter, an image forming device according to the embodiment is explained. The image forming device according to the embodiment is an image forming device that forms an image by discharging liquid droplets. The image forming device includes the above described inkjet head 1 according to the embodiment or the liquid cartridge 80 of FIG. 6, which is the integrated inkjet head unit. Here, an inkjet recording device 90 which is an image forming device including the inkjet head 1 according to the embodiment is explained as an example by referring to FIGS. 7 and 8. FIG. 7 is a perspective view illustrating the inkjet recording device 90. FIG. 8 is a side view illustrating mechanical portions of the inkjet recording device 90.

A printing unit 91 is stored inside a main body of the inkjet recording device 90. The printing unit 91 includes, at least, a carriage 98 that is movable in the main scanning direction; the inkjet heads (recording heads) 1 according to the embodiment, which are mounted on the carriage 98; and ink cartridges 99 that supply inks to the corresponding inkjet heads 1. A paper feed cassette (or paper feed tray) 93, on which many recording papers 92 can be stacked, can be detachably attached to a lower portion of the main body of the inkjet recording device 90 from the front side of the main body. Further, the inkjet recording device 90 includes a manual feed tray 94 that can be opened for manually feeding the recording paper 92. The inkjet recording device 90 takes in the recording paper 92 fed from the paper feed cassette 93 or the manual feed tray 94, and after forming a desired image on the recording paper using the printing unit 91, the inkjet recording device 90 ejects the recording paper 92 onto a paper eject tray 95.

The printing unit 91 includes a main guide rod 96 supported by left and right side plates (not shown) and a sub guide rod 97, and the printing unit 91 supports the carriage 98, which is slideably in the main scanning direction. The inkjet heads 1, which discharge yellow (Y) ink droplets, cyan (C) ink droplets, magenta (M) ink droplets, and black (Bk) ink droplets, respectively, are attached to the carriage 98 so that plural ink discharging ports (nozzles) of the inkjet heads 1 are arranged in lines in a direction perpendicular to the main scanning direction, and the ink discharging direction of the inkjet heads 1 is directed downward. Further, ink cartridges 99 for supplying the yellow ink, the cyan ink, the magenta ink, and the black ink, respectively, are replaceably attached to the carriage 98.

Each of the ink cartridges 99 includes an air inlet arranged at an upper side of the ink cartridge 99; and a supply port for supplying the corresponding ink to the corresponding inkjet head 1, the supply port being arranged at a lower side of the ink cartridge 99; and a porous body filled with the corresponding ink, the porous body arranged inside the ink cartridge 99. Each of the ink cartridges 99 retains the corresponding ink to be supplied to the corresponding inkjet head 1 so that the corresponding ink has a slight negative pressure by the capillary force of the porous body. Here, as the inkjet head 1, the inkjet heads 1 corresponding to the yellow ink, the cyan ink, the magenta ink, and the black ink are used. However, the inkjet head 1 may be a single liquid discharging head having plural nozzles that discharge the yellow ink, the cyan ink, the magenta ink, and the black ink, respectively.

Here, a rear side of the carriage 98 (downstream side in the paper conveyance direction) is slideably fixed to the main guide rode 96, and a front side of the carriage 98 (upstream side in the paper conveyance direction) is slideably placed on the sub guide rod 97. Further, in order to cause the carriage 98 to move and scan in the main scanning direction, a timing belt 104 is hung around a drive pully 102 being rotationally driven by a main scanning motor 101 and a driven pully 103, and the timing belt 104 is fixed to the carriage 98. Thus the carriage 98 reciprocates by the forward and reverse rotations of the main scanning motor 101.

On the other hand, the inkjet recording device 90 includes a paper feeding roller 105 and a friction pad 106 for feeding the recording papers 92 from the paper feed cassette 93 and for separating the recording papers 92; a guide member 107 for guiding the recording paper 92; a conveyance roller 108 that inverts the recording paper 92 being fed and conveys the recording paper 92; a pressing roller 109 that is pressed to a peripheral surface of the conveyance roller 108; and a top end roller 110 that defines an angle of sending the recording paper 92 from the conveyance roller 108, so as to convey the recording papers 92 being set in the paper feed cassette 93 to a lower side of the inkjet heads 1. The conveyance roller 108 is rotationally driven by a sub-scanning motor through a gear.

Further, the inkjet recording device 90 includes a printing support member 111 that corresponds to a moving range in the main scanning direction of the carriage 98 and that is for guiding the recording paper 92 being sent from the conveyance roller 108 at the lower side of the inkjet heads 1. At the downstream side in the recording paper conveyance direction of the printing support member 111, the inkjet recording device 90 further includes a conveyance roller 112 and a spur 113 that are rotationally driven so as to send the recording paper 92 in the paper ejection direction; a paper eject roller 114 and a spur 115 for sending the recording paper 92 onto the paper eject tray 95; and guide members 116 and 117 that form a paper ejection path.

During recording using the inkjet recording device 90, the inkjet head 1 is driven in accordance with an image signal while the carriage 98 is moved. In this manner, the inkjet heads 1 discharge the inks onto the recording paper 92, which has been stopped, and recording corresponding to one line is completed. Subsequently, the inkjet recording device 90 starts recording the next line after moving the recording paper 92 by a predetermined distance. When a recording termination signal or a signal is received indicating that the end of the recording paper 92 has reached a recording area, the inkjet recording device 90 terminates the recording operation and ejects the recording paper 92.

Further, the inkjet recording device 90 includes a recovering device 118 for recovering a discharge failure of the inkjet heads 1. The recovering device 118 is arranged at a position outside the recording area. Here, the position is at a rightmost side in a direction in which the carriage 98 moves. The recovering device 118 includes a cap unit, a suction unit, and a cleaning unit. During the print waiting state of the inkjet recording device 90, the carriage 98 is moved to the side of the recovering device 118, and the inkjet heads 1 are capped by the cap unit. In this manner, the wet condition of the ink discharging ports is kept, and a discharge failure caused by ink drying is prevented. Further, during recording, the inkjet recording device 90 causes the inkjet heads 1 to discharge inks that are not related to the recording. In this manner, ink viscosities at all the ink discharging ports are kept constant, and a stable discharging condition of the inkjet heads 1 is maintained.

Further, when a discharge failure occurs, the inkjet recording device 90 causes the cap unit to seal the discharging ports of the inkjet heads 1. Then the suction unit suctions bubbles along with the inks from the discharging ports through a tube. The cleaning unit removes the inks or dusts accumulated on the surface of the discharging ports. In this manner, the discharge failure is recovered. Further, the suctioned inks are discharged to a waste ink reservoir (not shown) arranged at a lower portion of the main body of the inkjet recording device 90, and an ink absorber in the waste ink reservoir absorbs and reserves the suctioned inks.

As described above, since the inkjet recording device 90 includes the inkjet heads 1, a stable ink discharging characteristic is obtained and the quality of the image is improved. Here, the case is explained in which the inkjet head 1 is applied to the inkjet recording device 90. However, the embodiment is not limited to this. For example, the inkjet head 1 may be applied to a device that discharges liquid droplets other than ink droplets, such as liquid droplets of a liquid resist for patterning.

The embodiment has been explained using the accompanying figures. However, the embodiment is not limited to the aspects indicated in the figures. The embodiment may be modified within a range where a person skilled in the art can conceive. For example, another embodiment may be added to the embodiment, a portion of the embodiment may be modified, or a portion of the embodiment may be deleted. The modified embodiments are included within the scope of the embodiment, provided that the modified embodiments demonstrate the functions and effects of the embodiment of the present invention.

Examples in which the embodiment of the present invention is applied include, at least, MEMS devices that include micro-actuators utilizing piezoelectric elements. Specifically, the examples include an optical device including micromirrors, such as a projector, and a micro-pump for supplying fluid to infinitesimal fluid channels.

The present invention is not limited to the specifically disclosed embodiments, and variations and modifications may be made without departing from the scope of the present invention.

The present application is based on Japanese Priority Application No. 2011-026905 filed on Feb. 10, 2011, the entire contents of which are hereby incorporated herein by reference.

What is claimed is:

1. An inkjet head comprising:

plural individual liquid chambers formed with partition walls, each of the individual liquid chambers having a liquid droplet discharging hole;

an oscillation plate attached to surfaces of plural of the individual liquid chambers, the surfaces of plural of the individual liquid chambers being different from surfaces where the liquid droplet discharging holes are provided;

plural piezoelectric elements arranged at positions corresponding to the plural of the individual liquid chambers on the oscillation plate, each of the piezoelectric elements being formed by laminating a lower electrode, a piezoelectric material, and an upper electrode, in this order on the oscillation plate, wherein the lower electrode is a common electrode and the upper electrode is an individual electrode;

a common electrode wiring connected to the lower electrode; and individual electrode wirings individually and conductively connected to the corresponding upper electrodes of plural of the piezoelectric elements, wherein driving signals are individually input to the corresponding individual electrode wirings, wherein the inkjet head further includes an upper layer insulator film that coats at least the common electrode wiring and surfaces of the individual electrode wirings;

an intermediate layer insulator film that is provided between the individual electrode wirings and the lower electrode, at least, at areas where the individual electrode wirings and the lower electrode overlap, the intermediate layer insulator film being a lower layer of the upper layer insulator film; and a lower layer insulator film that coats, at least, surfaces of the piezoelectric elements, the lower layer insulator film being a lower layer of the intermediate layer insulator film, wherein the intermediate layer insulator film and the upper layer insulator film have openings therein for exposing the piezoelectric elements, wherein widths of the openings are greater than width of each of the piezoelectric elements, and the widths of the openings are less than width of each of the individual liquid chambers, and wherein, in a width direction of the piezoelectric elements, each of the piezoelectric elements is disposed inside the corresponding opening.

2. The inkjet head according to claim 1, wherein the lower layer insulator film is a protective film that protects the piezoelectric elements from plasma in a manufacturing process of the inkjet head and from moisture in a usage environment of the inkjet head.

3. The inkjet head according to claim 2, wherein the lower layer insulator film is a thin film formed of an inorganic material including at least one of $Al_2O_3$, $ZrO_2$, $Y_2O_3$, $Ta_2O_5$, and $TiO_2$.

4. The inkjet head according to claim 3, wherein thickness of the lower layer insulator film is in a range from 20 nm to 100 nm.

5. The inkjet head according to claim 1, wherein the intermediate layer insulator film is n interlayer insulator film between the individual electrode wirings and the lower electrode.

6. The inkjet head according to claim 5, wherein the intermediate layer insulator film is formed of $SiO_2$.

7. The inkjet head according to claim 6, wherein thickness of the intermediate layer insulator is greater than or equal to 200 nm.

8. The inkjet head according to claim 1, wherein the upper layer insulator film is a passivation film that protects the common electrode wiring and the individual electrode wirings from a usage environment of the inkjet head.

9. The inkjet head according to claim 8, wherein the upper layer insulator film is formed of $Si_3N_4$.

10. The inkjet head according to claim 9, wherein thickness of the upper layer insulator film is greater than or equal to 200 nm.

11. The inkjet head according to claim 8, wherein the thickness of the upper layer insulator film is greater than thickness of the intermediate layer insulator film.

12. An image forming device that includes an inkjet head comprising:

plural individual liquid chambers formed with partition walls, each of the individual liquid chambers having a liquid droplet discharging hole;

an oscillation plate attached to surfaces of plural of the individual liquid chambers, the surfaces of plural of the individual liquid chambers being different from surfaces where the liquid droplet discharging holes are provided;

plural piezoelectric elements arranged at positions corresponding to the plural of the individual liquid chambers on the oscillation plate, each of the piezoelectric elements being formed by laminating a lower electrode, a piezoelectric material, and an upper electrode, in this order on the oscillation plate, wherein the lower electrode is a common electrode and the upper electrode is an individual electrode;

a common electrode wiring connected to the lower electrode; and individual electrode wirings individually and conductively connected to the corresponding upper electrodes of plural of the piezoelectric elements, wherein driving signals are individually input to the corresponding individual electrode wirings, wherein the inkjet head further includes an upper layer insulator film that coats at least the common electrode wiring and surfaces of the individual electrode wirings;

an intermediate layer insulator that is provided between the individual electrode wirings and the lower electrode, at least, at areas where the individual electrode wirings and the lower electrode overlap, the intermediate layer insulator film being a lower layer of the upper layer insulator film; and a lower layer insulator film that coats, at least, surfaces of the piezoelectric elements, the lower layer insulator film being a lower layer of the intermediate layer insulator film, wherein the intermediate layer insulator film and the upper layer insulator film have openings therein for exposing the piezoelectric elements, wherein widths of the openings are greater than width of each of the piezoelectric elements, and the widths of the openings are less than width of each of the individual liquid chambers, and wherein, in a width direction of the piezoelectric elements, each of the piezoelectric elements is disposed inside the corresponding opening.

* * * * *